US008276417B2

(12) United States Patent
Zhang

(10) Patent No.: US 8,276,417 B2
(45) Date of Patent: Oct. 2, 2012

(54) RIM LOCK WITH REMOVABLE CYLINDERS

(75) Inventor: Jack Zhang, Xiamen (CN)

(73) Assignee: Newfrey LLC, Newark, DE (US)

( * ) Notice: Subject to any disclaimer, the term of this patent is extended or adjusted under 35 U.S.C. 154(b) by 290 days.

(21) Appl. No.: 12/750,003

(22) Filed: Mar. 30, 2010

(65) Prior Publication Data

US 2011/0239713 A1 Oct. 6, 2011

(51) Int. Cl.
*E05B 17/04* (2006.01)

(52) U.S. Cl. ..... 70/379 R; 70/190; 70/367; 70/371

(58) Field of Classification Search ..... 70/367–374, 70/379 R, 379 A, 380, 190, 191
See application file for complete search history.

(56) References Cited

U.S. PATENT DOCUMENTS

| | | | | |
|---|---|---|---|---|
| 978,964 | A * | 12/1910 | Voight | 70/380 |
| 2,210,186 | A * | 8/1940 | Ross | 70/267 |
| 2,603,081 | A | 7/1952 | Pelle | |
| 2,620,646 | A | 12/1952 | McConnell | |
| 2,991,644 | A | 7/1961 | Edwards et al. | |
| 3,186,199 | A * | 6/1965 | Schwartz | 70/370 |
| 3,203,210 | A * | 8/1965 | Check et al. | 70/340 |
| 3,383,886 | A * | 5/1968 | Hermann | 70/284 |
| 3,408,841 | A * | 11/1968 | Hsu | 70/390 |
| 3,423,972 | A | 1/1969 | Marti et al. | |
| 4,850,210 | A | 7/1989 | Adler et al. | |
| 4,912,953 | A | 4/1990 | Wobig | |
| 5,211,044 | A * | 5/1993 | Kim | 70/371 |
| 5,325,690 | A | 7/1994 | Adler et al. | |
| 6,141,997 | A * | 11/2000 | Blehi, III | 70/56 |
| 6,513,351 | B2 * | 2/2003 | Clark | 70/101 |
| 7,096,697 | B2 | 8/2006 | Keightly | |
| 7,275,401 | B1 * | 10/2007 | Zimmerman | 70/379 R |
| 7,334,439 | B2 * | 2/2008 | Ruan | 70/224 |
| 7,343,763 | B2 * | 3/2008 | Dolev | 70/379 R |
| 7,373,795 | B2 * | 5/2008 | Kilbourne | 70/278.1 |
| 7,856,856 | B2 * | 12/2010 | Shvartz | 70/107 |

FOREIGN PATENT DOCUMENTS

| | | |
|---|---|---|
| EP | 0576787 | 1/1994 |
| JP | 4093423 | 3/1992 |

* cited by examiner

*Primary Examiner* — Suzanne Barrett
(74) *Attorney, Agent, or Firm* — John D. DelPonti; Richard J. Veltman; Newfrey LLC

(57) ABSTRACT

A rim lock includes interior and exterior lock assemblies. Each lock assembly includes a lock cylinder that is removable without removing the rim lock from the door.

7 Claims, 12 Drawing Sheets

RIM LOCK WITH REMOVABLE CYLINDERS

The present invention relates to rim locks in general and to rim locks with removable lock cylinders in particular.

DETAILED DESCRIPTION OF THE DRAWINGS

Figure 1:
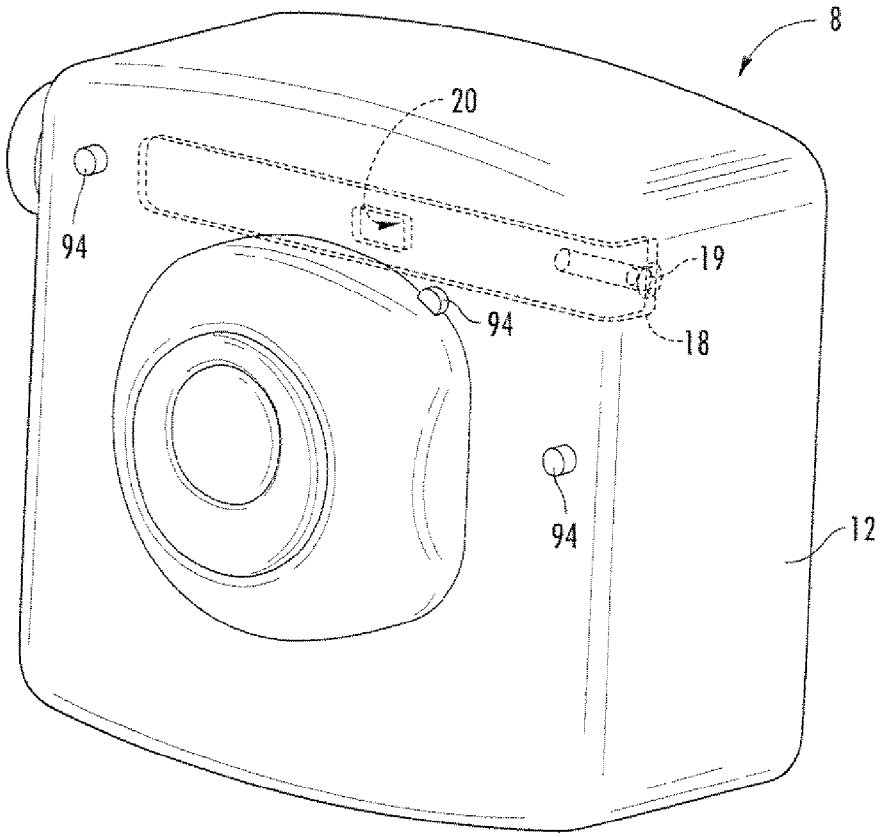
FIG. 1 illustrates a rim lock.
Figure 2:
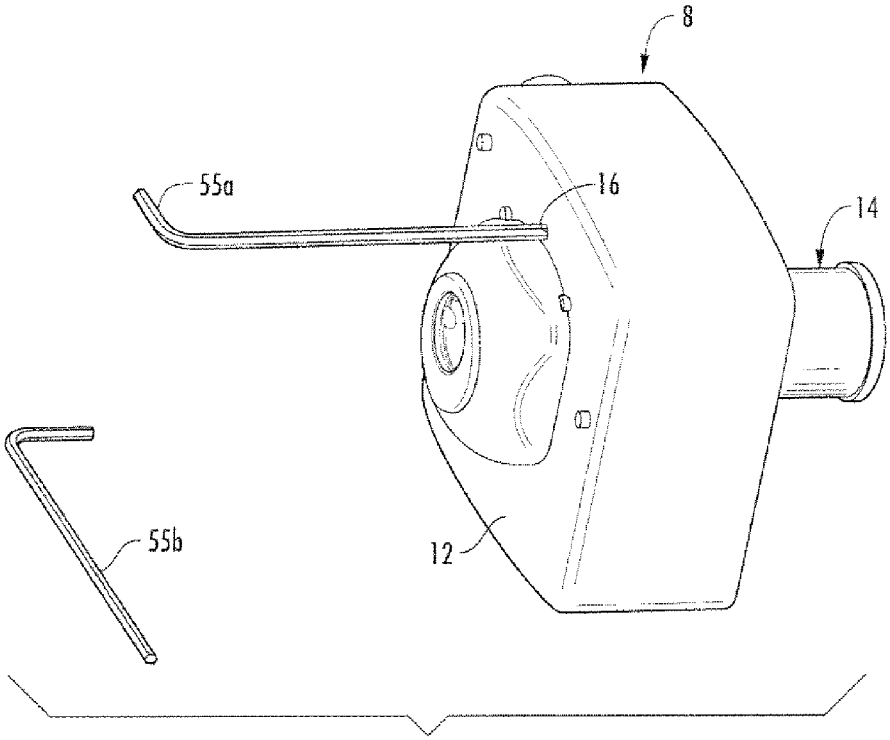
FIG. 2 is another view of the rim lock of FIG. 1.

An exemplary rim lock 8 is illustrated in FIGS. 1 and 2. The rim lock 8 may include an interior lock assembly 10 (FIG. 3) disposed in a case 12 configured to be attached to the interior surface of a door (not shown) and an exterior lock assembly 14 configured to extend from the case through the door. The case 12 may include an access aperture 16. A slide 18 can be mounted on the inside of the case 12 and may include an aperture 20 that can be aligned with the access aperture 16 to provide access to an internal mechanism for removing the lock cylinders from the lock assemblies 10, 14. In preferred embodiments, the slide 18 can be moved by rotating a machine screw 19 or the like coupled to the slide 18.

Figure 4:
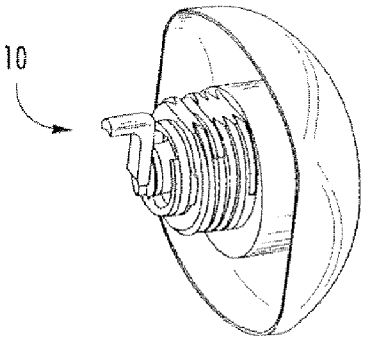
FIG. 4 illustrates an assembled lock assembly.
Figure 3:
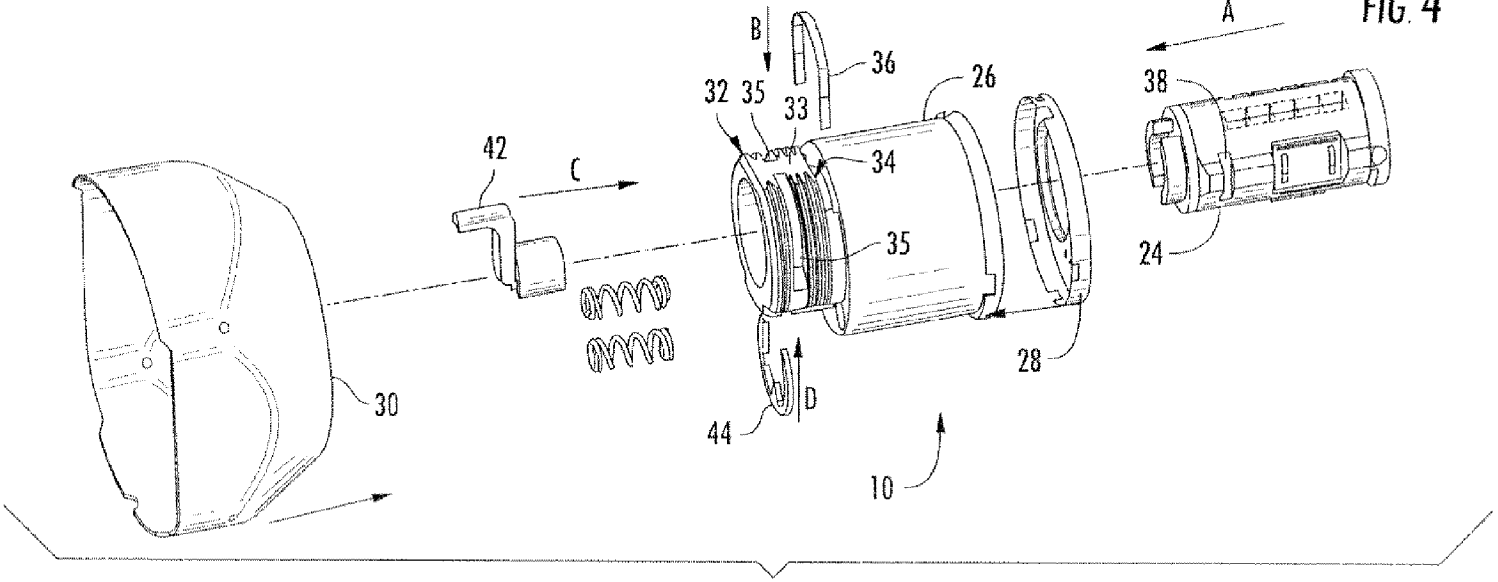
FIG. 3 is an exploded view of a lock assembly for use with the rim lock of FIG. 1.

The interior lock assembly 10, illustrated in FIG. 3, has a longitudinal axis 22 and may include a lock cylinder 24, a generally cylindrical lock housing 26, a face plate 28. A cover 30 may be provided as a decorative housing for the interior lock assembly 10. The lock housing 26 can have a threaded portion 32 that includes a flat 33, an opening 34, and a pair of opposing slots 35. As illustrated in FIG. 3, the lock cylinder 24 can be inserted into the lock housing 26 in the direction of arrow A and a retaining clip 36 can be inserted into the opening 34 in the direction of arrow B to engage slots 38 formed in the cylinder 24, thereby retaining the cylinder 24 in the housing 26. A bolt actuator 42 can be inserted into the housing 26 in the direction of arrow C to engage the lock cylinder 24 and a retainer 44 can be inserted into slots 35 in the direction of arrow D to engage the bolt actuator 42, thereby retaining the bolt actuator 42 in the lock housing 26 and engaged with the lock cylinder 24. The exterior lock assembly 14 can include substantially similar components and features and can be assembled in substantially the same manner. The assembled lock assembly 10 is covered by the lock housing cover 30 and the combined lock assembly and cover, illustrated in FIG. 4, can be installed in an opening in the case 12.

Figure 5:
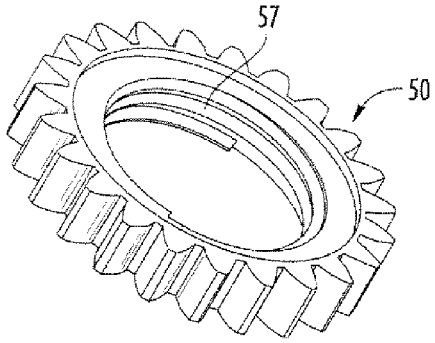
FIGS. 5-8 illustrate components of a drive mechanism for use with the rim lock of FIG. 1.
Figure 6:
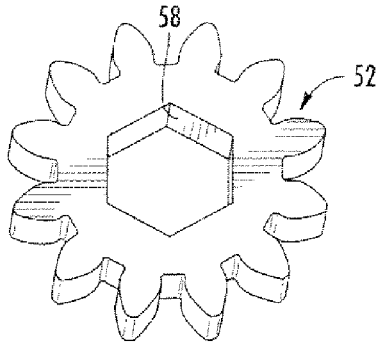
Figure 7:
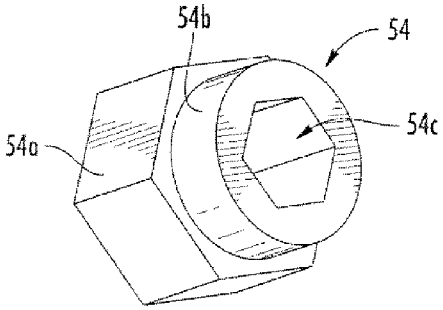
Figure 8:
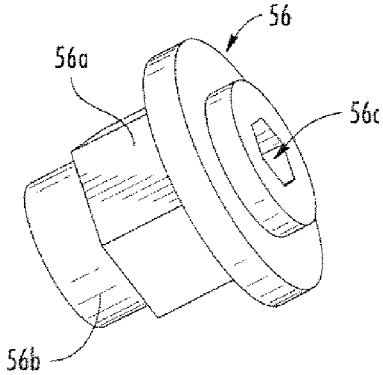

FIGS. 5-8 illustrate components of a drive mechanism that can be used for removing the lock cylinders 10, 14 from the rim lock 8. FIG. 5 illustrates a driven gear 50 and FIG. 6 illustrates a drive gear 52. In some embodiments, the gears 50, 52 can be replaced with friction wheels. FIGS. 7 and 8 illustrate first and second mounting hubs 54, 56, respectively, for mounting the drive gears 52, 52*a* (FIGS. 14 and 15), respectively, in the case 12.

As illustrated in FIGS. 7 and 8, each mounting hub can include a polygonal portion 54*a*, 56*a*, a cylindrical portion 54*b*, 56*b*, and a central bore 54*c*, 56*c*. The central bores 54*c*, 56*c* may be configured to receive a tool, preferably an alien-type wrench 55*a*, 55*b* as illustrated in FIG. 2, with the central bore 54*c* being larger than the central bore 56*c*.

Driven gear 50 can include internal threads 57 that are sized and configured to screw onto the threaded portion 32 of the lock housing 26. Drive gear 52 can include a polygonal central opening 58 sized and configured to receive a polygonal portion of mounting hubs 54*a*, 56*a*.

Figure 9:
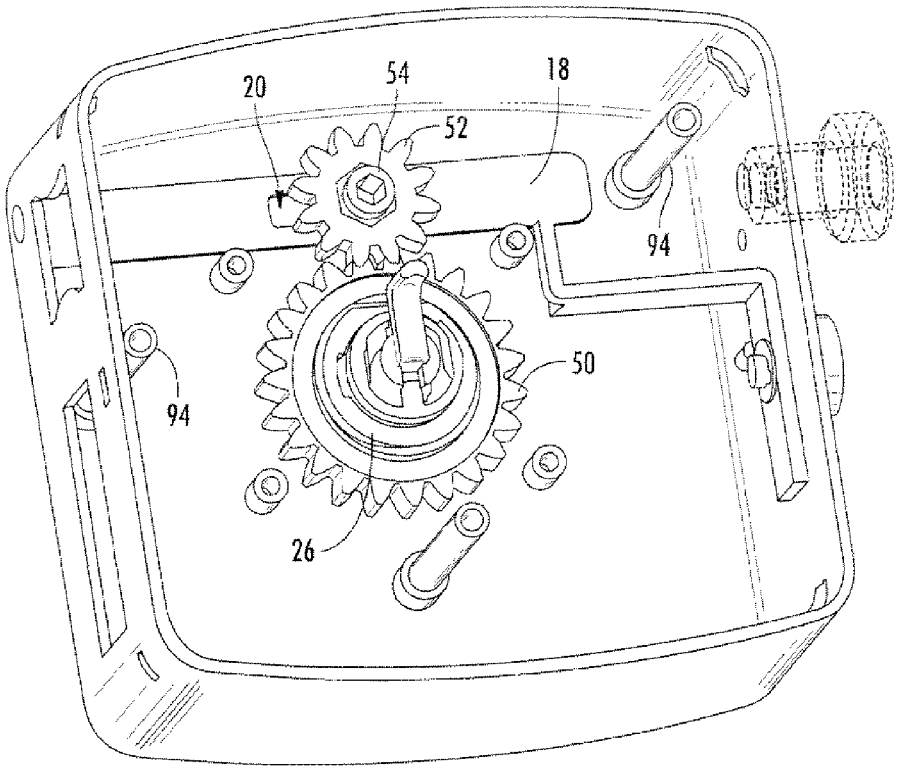
FIG. 9 illustrates the positioning of the components of FIGS. 5 and 6 in the rim lock of FIG. 1.
Figure 10:
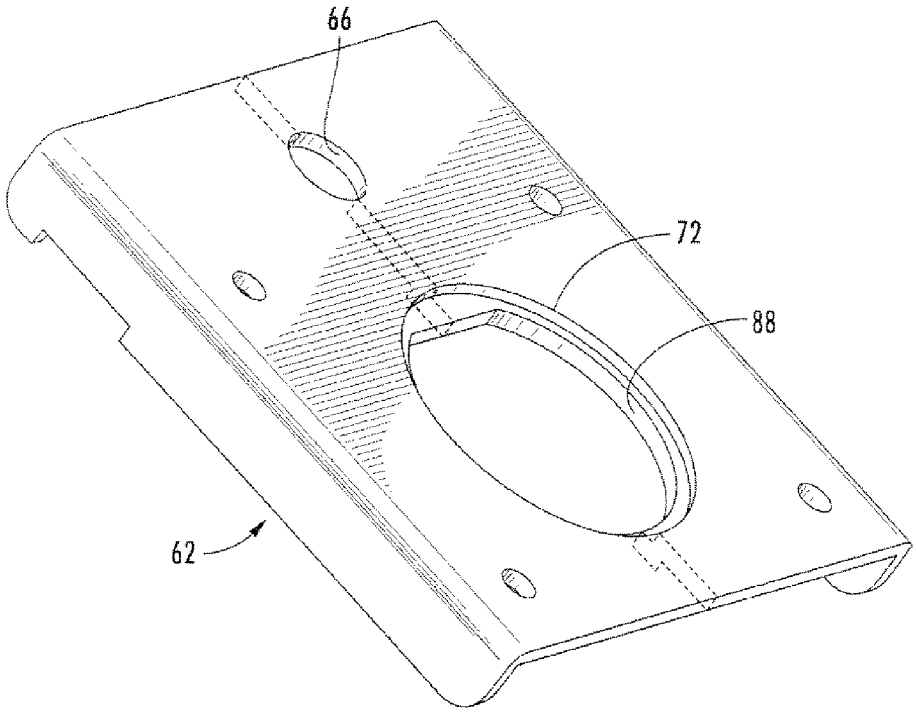
FIG. 10 illustrates a first plate.
Figure 11:
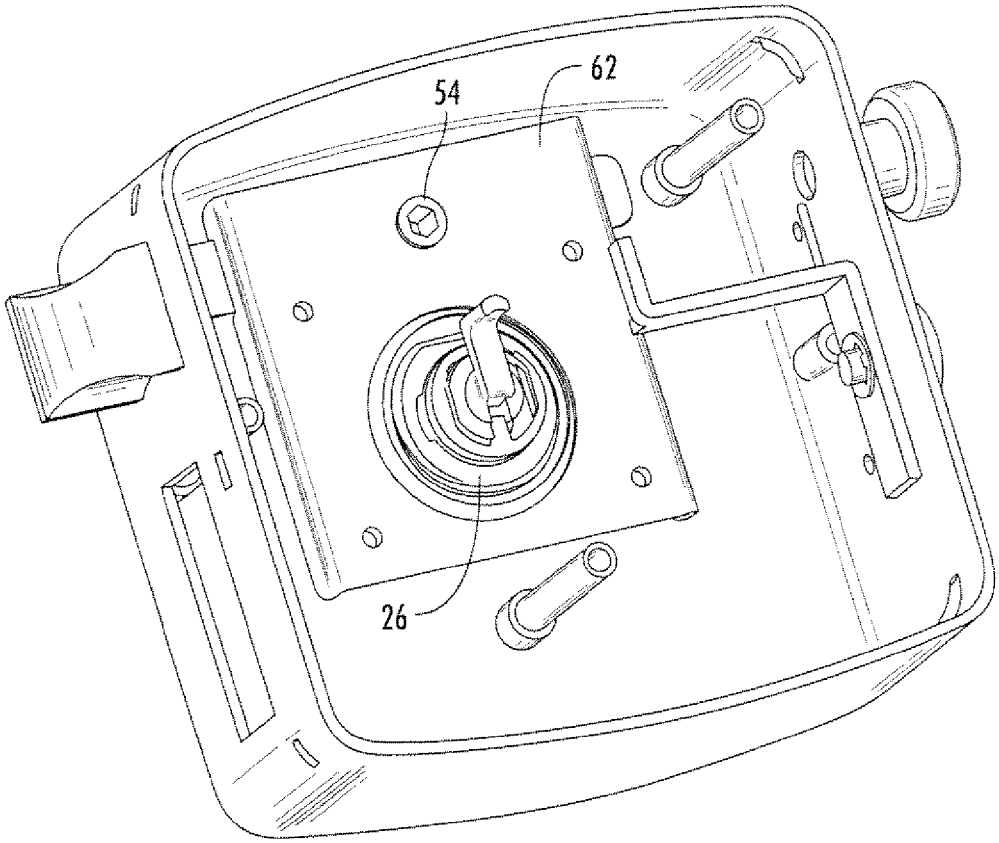
FIG. 11 illustrates the first plate in position to retain the lock assembly in the rim lock.
Figure 14:
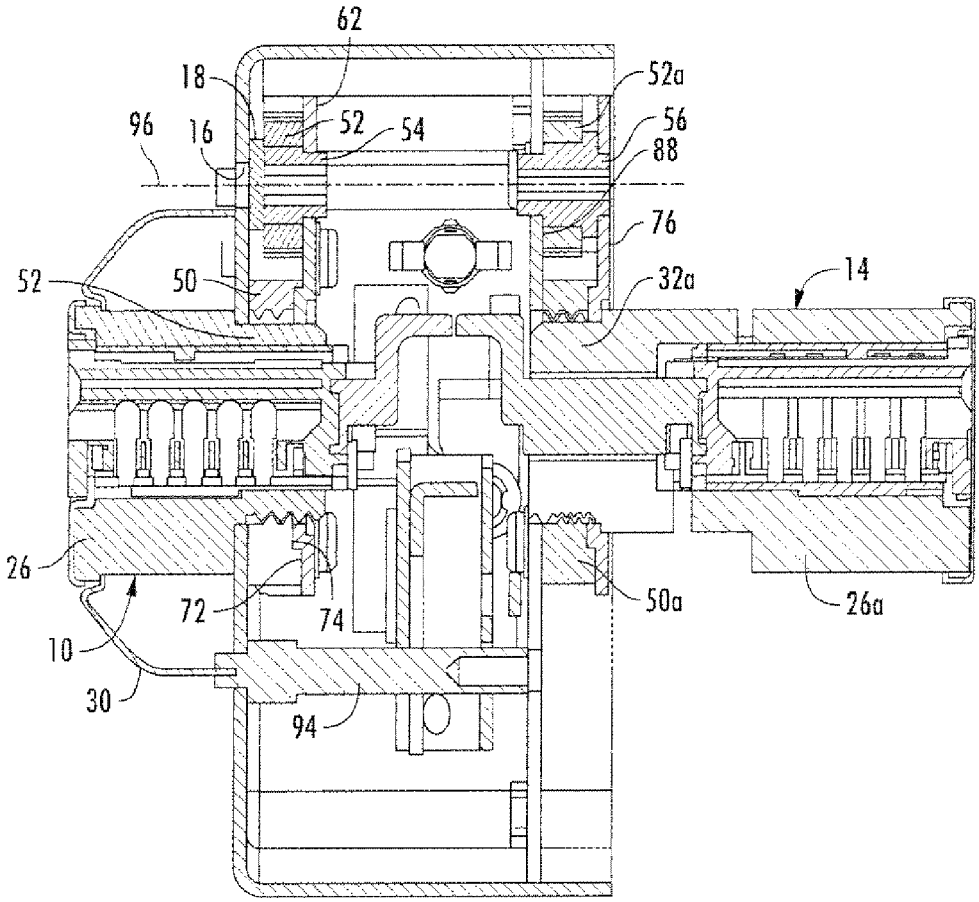
FIG. 14 is a section view taken along the longitudinal axis of the lock assembly of FIG. 3.

The drive gear 52, mounted on the hub 54, can be aligned with the access aperture 16 formed in the case 12 and positioned to engage the driven gear 50 attached to the lock housing 26, as illustrated in FIG. 9. A first plate 62, illustrated in FIG. 10, can be installed to retain the lock housing 26 with driven gear 52 and the hub 54 with drive gear 52 in the case 12, as illustrated in FIG. 11. The first plate 62 can include a first aperture 66 sized and configured to receive the cylindrical portion of the hub 54 and a second aperture 68 sized and configured to receive the cylinder housing 26. The second aperture 68 can include an annular recess 72 configured to mate with a complementary shoulder 74 formed on the driven gear 50 (FIG. 14).

Figure 12:
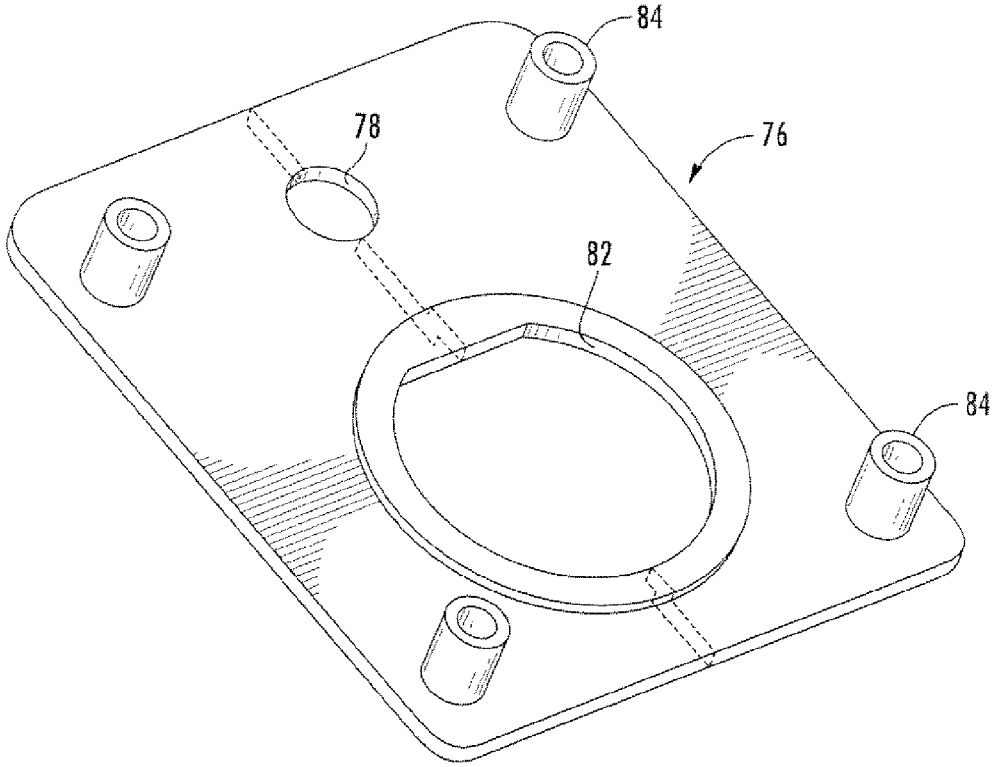
FIG. 12 illustrates a second plate.

A second plate 76, illustrated in FIG. 12, can include a first aperture 78 sized and configured to receive the cylindrical portion of the hub 56 and a second aperture 82 sized and configured to receive the threaded portion of the exterior lock housing 26*a*. The plate 76 can further include a plurality of bosses 84 extending from one surface, with the height of the bosses 84 being slightly greater than the thickness of a second set of drive and driven gears 50*a*, 52*a*.

Figure 13:
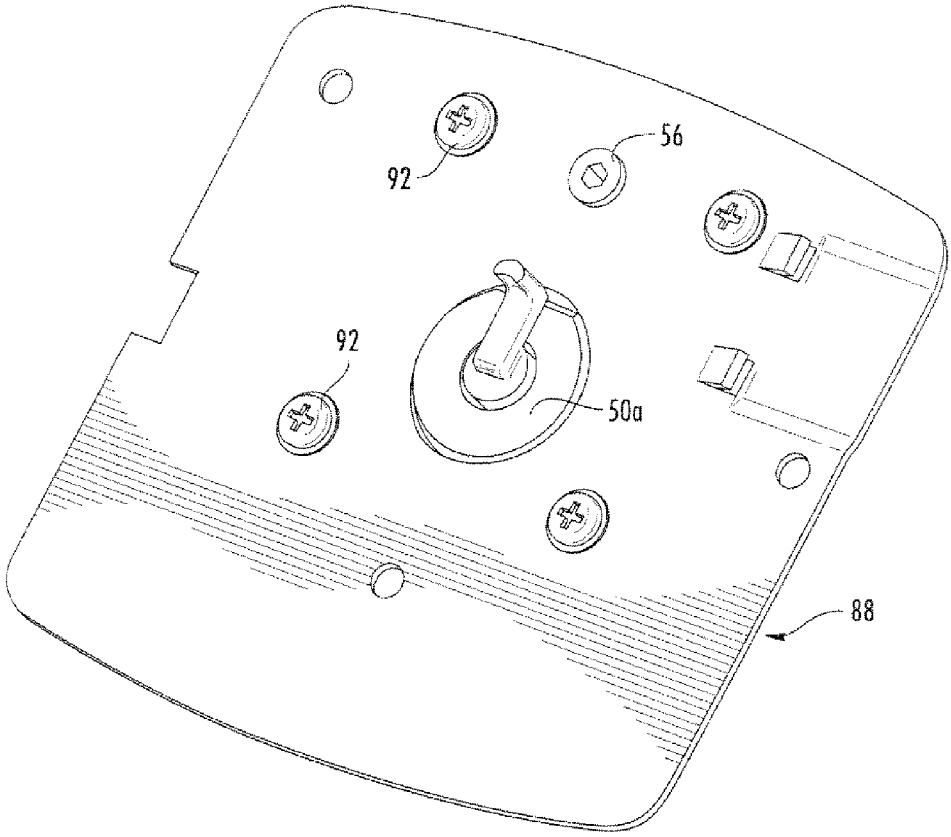
FIG. 13 illustrates a third plate.

The exterior lock assembly 14 can be installed on the second plate 76, and held in place against the second plate 76, by a second driven gear 52*a* threaded on the threaded portion 32*a* of the lock housing 26*a*. The mounting hub 56 can be positioned in the first aperture 78, and a third plate 88, illustrated in FIG. 13, can be coupled to the second plate 76 by, for example, fasteners 92 screwed into bosses 84, thereby retaining the exterior lock assembly 14, the second driven gear 50*a*, and the second drive gear 52*a* with mounting hub 56 between the second and third plates 76, 88, as illustrated in FIGS. 14 and 15.

A plurality of studs 94 can be attached to the case 12 to extend into the interior of the case 12. The second and third plates 76, 88 can be secured to the case 12 by fasteners extending through apertures in the third plate 88 into the studs 94. Thus, the exterior lock assembly 14 is attached to the case, which can then be attached to the door.

Figure 15:
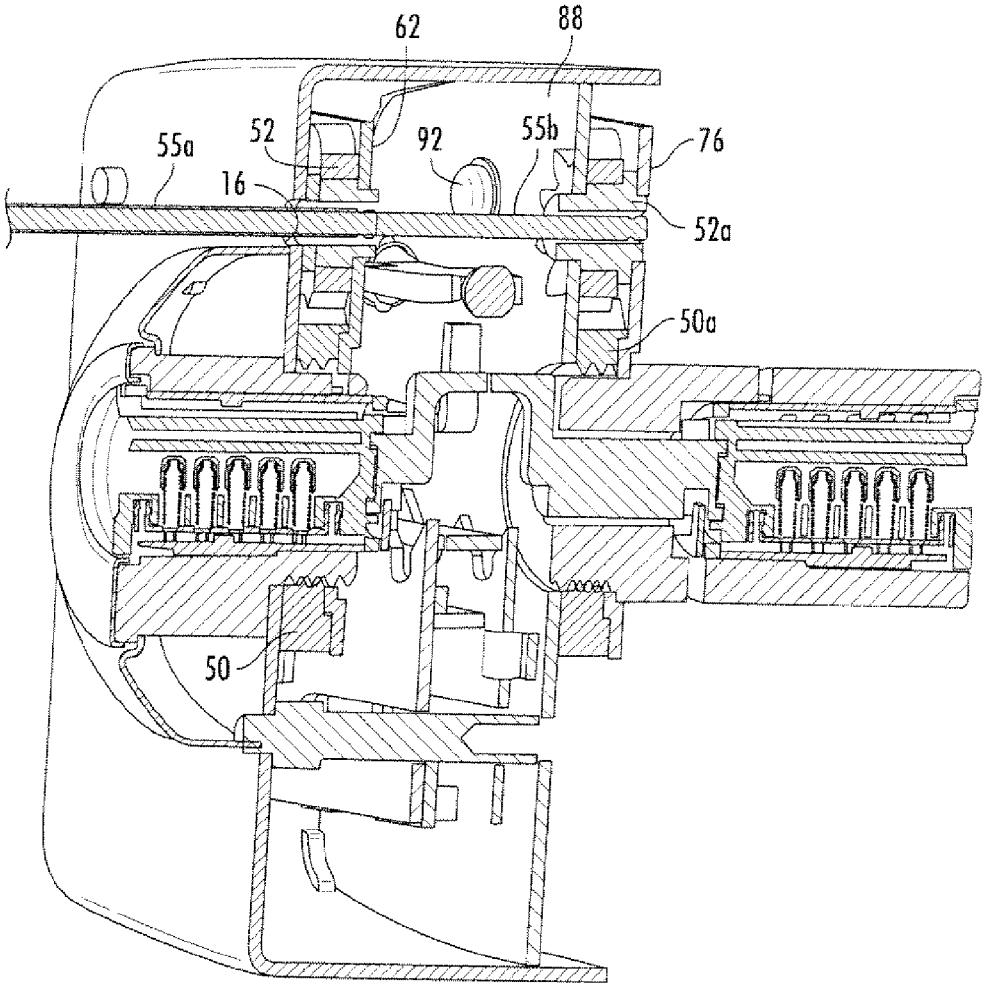
FIG. 15 is a cut-away perspective view of the rim lock.

As illustrated in FIGS. 14 and 15, the mounting hubs 54 and 56 are aligned with the access aperture 16 and lie along a common longitudinal axis 96. This alignment allows alien wrench 55*b* to pass through the mounting hub 54 to engage the mounting hub 56 to rotate the drive gear 52*a* to remove the exterior lock assembly and a second, larger alien wrench 55*a* to engage the mounting hub 54 to remove the interior lock assembly 10.

Figure 16:
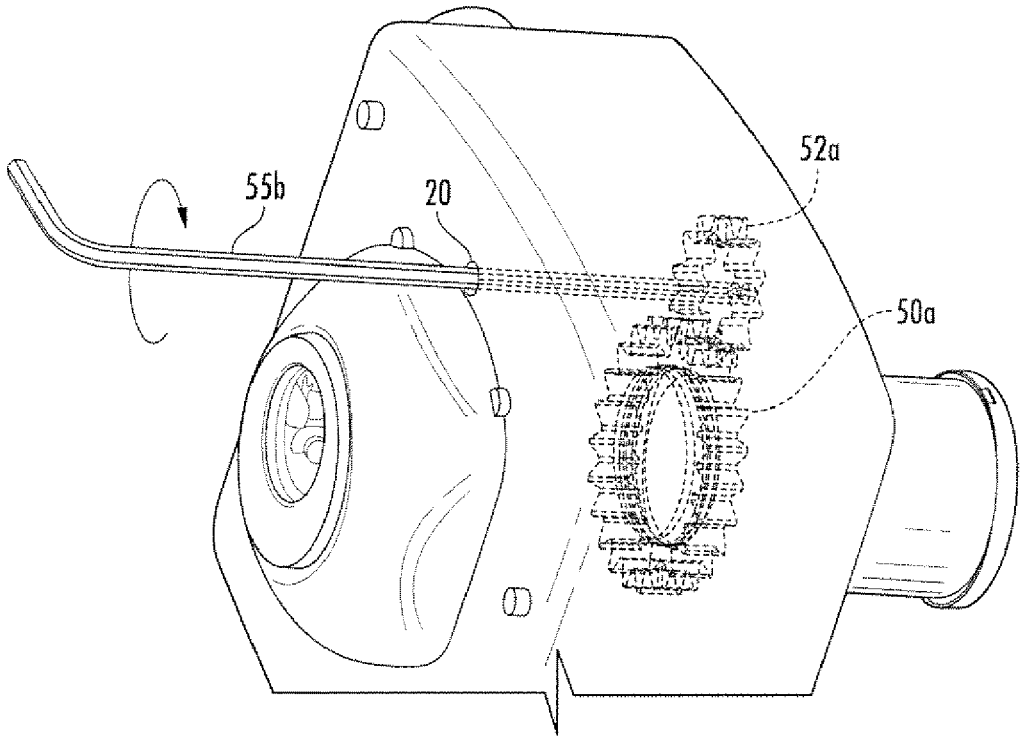
FIG. 16 is a partial perspective view of the rim lock of FIG. 1.

Thus, to remove the exterior lock assembly 14, a user moves the slide 18 to align aperture 20 with the access aperture 16. The user then inserts a first alien wrench into the access aperture 16, through the first mounting hub 54 and into the second mounting hub 56, as illustrated in FIGS. 15 and 16.

By rotating the alien wrench, the user rotates the second drive gear 52*a* which, in turn, rotates the second driven gear 50*a*. With the driven gear 52*a* retained in position between the second and third plates 76, 88, the threaded engagement between the second driven gear 50*a* and the threaded portion 32*a* of the lock housing 26*a* forces the exterior lock assembly 14 to move longitudinally.

In a similar fashion, a user can remove the internal lock assembly 10 by moving the slide 18 to align aperture 20 with the access aperture 16 and insert a second alien wrench into the first mounting hub 54. By rotating the second alien wrench, the user rotates the first drive gear 52 which, in turn, rotates the first driven gear 50. With the driven gear 52 retained in position between the first and second plates 62, 76, the threaded engagement between the first driven gear 50 and the threaded portion 32 of the lock housing 26 forces the interior lock assembly 10 to move longitudinally.

The invention claimed is:

1. A rim lock comprising;

a case;

an interior lock assembly coupled to the case;

an exterior lock assembly coupled to the case, the interior and exterior lock assemblies having a common longitudinal axis;

a first driven gear coupled to the interior lock assembly;

a second driven gear coupled to the exterior lock assembly;

a first drive gear disposed to engage and rotate the first driven gear; and a second drive gear disposed to engage and rotate the second driven gear;

the interior lock assembly being configured to be driven longitudinally in response to rotation of the first driven gear and the exterior lock assembly being configured to be driven longitudinally in response to rotation of the second driven gear.

2. The rim lock of claim 1 wherein the interior lock assembly includes an externally threaded portion and the first driven gear includes a central aperture with complementary internal threads.

3. The rim lock of claim 2 wherein the first and second drive gears are accessible through an aperture formed in the case and are rotatable about a common axis.

4. The rim lock of claim 2 wherein the first and second drive gears are mounted on first and second mounting hubs, respectively, the first mounting hub having a first central aperture for receiving a first tool and the second mounting hub having a second central aperture for receiving a second tool, the first central aperture being larger than the second central aperture.

5. A rim lock comprising:

a case;

a lock assembly coupled to the case and having a longitudinal axis;

a first driven gear coupled to the lock assembly;

a first drive gear disposed to engage the driven gear, the driven gear rotating in response to rotation of the drive gear and the lock assembly moving longitudinally in response to rotation of the driven gear:

a second lock assembly coupled to the case, a second driven gear coupled to the second lock assembly, and a second drive gear disposed to engage the second driven gear, the second driven gear rotating in response to rotation of the second drive gear and the second lock assembly moving longitudinally in response to rotation of the second driven gear.

6. The rim lock of claim 5 wherein the first and second drive gears are aligned along an axis parallel to the longitudinal axis.

7. The rim lock of claim 5 further including first and second mounting hubs rotatably disposed in the case, the first and second drive gears being mounted on the first and second hubs, respectively.

* * * * *